United States Patent [19]

Baumgaertner et al.

[11] 4,221,262

[45] Sep. 9, 1980

[54] HEAT EXCHANGER FOR THE TRANSMISSION OF HEAT PRODUCED IN A HIGH TEMPERATURE REACTOR TO AN INTERMEDIATE CIRCUIT GAS

[75] Inventors: Heinrich Baumgaertner, Ketsch; Ekkehard Barchewitz, Mannheim, both of Fed. Rep. of Germany

[73] Assignee: Hochtemperatur-Reaktorbau GmbH., Cologne, Fed. Rep. of Germany

[21] Appl. No.: 848,601

[22] Filed: Nov. 4, 1977

[30] Foreign Application Priority Data

Nov. 6, 1976 [DE] Fed. Rep. of Germany ..... 2650922

[51] Int. Cl.[2] ..... F28D 7/10

[52] U.S. Cl. ..... 165/157; 122/32; 176/65

[58] Field of Search ..... 165/157, 160, 74; 122/32; 176/65, 60

[56] References Cited

U.S. PATENT DOCUMENTS

| | | | |
|---|---|---|---|
| 4,026,675 | 5/1977 | Marsch | 165/157 |
| 4,036,294 | 7/1977 | Ecker | 165/157 |
| 4,098,329 | 7/1978 | Culver | 176/65 |

FOREIGN PATENT DOCUMENTS

| | | | |
|---|---|---|---|
| 2517694 | 11/1976 | Fed. Rep. of Germany | 165/157 |

*Primary Examiner*—Charles J. Myhre
*Assistant Examiner*—Magdalen Moy
*Attorney, Agent, or Firm*—Schwartz, Jeffery, Schwaab, Mack, Blumenthal & Koch

[57] ABSTRACT

A heat exchanger apparatus is disclosed comprising a heat exchanger casing having a plurality of box members suspended within the casing, with each box member having a plurality of tubular members disposed within an arrangement which permits the exchange of heat from a hot gas stream flowing outside the tubular members to a cooler gas stream flowing counter-currently within the tubular members. The heat exchanger apparatus is adapted especially for the use in high temperature nuclear reactors and is disposed within a pod in the reactor pressure vessel communicating directly with the reactor core. The suspension of the primary heat exchange components enables the achievement of excellent exchange capability with minimum stress on the exchanger apparatus as a result of thermal expansion. A method of exchanging heat from a primary cooling circuit of a high temperature reactor to an intermediate gas circuit of a heat process plant is also disclosed.

16 Claims, 2 Drawing Figures

HEAT EXCHANGER FOR THE TRANSMISSION OF HEAT PRODUCED IN A HIGH TEMPERATURE REACTOR TO AN INTERMEDIATE CIRCUIT GAS

BACKGROUND OF THE INVENTION

1. Field of the Invention

The invention relates to a heat exchanger for the transmission of heat produced in a gas cooling circuit of a high temperature reactor to a gas circulating in an intermediate circuit for further use in a process heat plant. The heat exchanger is arranged in a pod within the reactor pressure vessel.

2. Description of the Prior Art

German Offenlegungsschrift No. 21 20 544 illustrates a heat exchanger for use in closed gas turbines. The heat exchanger has a number of tube bundles which are arranged in parallel and which have a round or polygonal cross-section. The bundles are surrounded by tubular casings which are open at both ends. The external heat exchanger medium, e.g. the waste gas coming from a turbine, flows within these casing tubes along the exchanger tubes such that its direction of flow is countercurrent to the flow of the medium in the tubes. Each tube assembly is provided with its own supply and removal lines. The casing tubes are inserted in a sealed and leakproof manner in a plate arranged horizontally to them, which is partially connected to the housing of the heat exchanger at its sealed portion.

A similar heat exchanger having tube assemblies surrounded by guide casings is described in the German Offenlegungsschrift No. 24 30 161. The tube assemblies designed as boxes are arranged in planar form in a hexagonal grating. The tube bottoms are arranged at least at one side in different horizontal planes. The heat exchanger is particularly suitable for use as a recuperator in the cooling circuit of a high temperature reactor having a helium-turbine. When used as such, it is arranged in a cavity in the wall of a prestressed concrete vessel. In the event the heat exchanger is to be suspended within the cavity, the boxes are suspended by means of thermo sleeves onto a supporting grate, which is partially mounted on the liner of the pod by means of a thermo sleeve. When used in a stationary arrangement, the heat exchanger rests on a supporting grate at the seam of an external ring and six spokes.

Furthermore, German Offenlegungsschrift No. 24 59 189 teaches a tube-bundle type of heat exchanger for gaseous medium, which also forms a part of a fully integrated nuclear reactor plant having a helium-turbin. The type bundles have a ring-shaped cross-section, and their collectors and distributors are designed as ring-shaped chambers. The distributors are connected across the supply lines through a spherical bottom which serves as a main distributor, as well as a supporting grate. The supply lines are fixed connected to the spherical bottom. The removal lines are led as compensating loops along the circumference of the heat exchanger upwards to a ring collector, at which place they penetrate the spherical bottom.

Additionally, one prior art recognized design of a nuclear power plant has a closed gas cooling circuit for the production of process heat, wherein a primary circuit and an intermediate circuit are arranged, so as to separate the heat exchanger to a high temperature part and a low temperature part. Both the high temperature part and the low temperature part are removably installed in separate pods within the prestressed concrete vessel. The reason for this particular arrangement is based on the fact that the high cooling-gas temperatures necessary for the purpose previously indicated only occur in the area of the gas inlet of the heat exchanger. Therefore, it is sufficient to provide only the high temperature portion of the heat exchanger with high resistance material capable of exhibiting a long service life. Since both heat exchanger parts are arranged in separate pods, the portion exposed to stress can be removed and separately replaced. Nevertheless, the splitting up of the heat exchanger into separate parts connected in series is done at the expense of the stability and structural integrity of the entire nuclear power plant.

It is, therefore, most desirable to construct heat exchangers for the removal of heat produced in high temperature reactors which are as compact as possible and convenient for integration into the prestressed reactor vessel for reasons of technical safety. Furthermore, the heat exchanger must be gas-tight even under extreme pressure differences which may arise as a result of accidental distrubances, that is, no radioactively contaminated coolant may be permitted to enter the intermediate circuit. Since for reasons of efficiency, it is also necessary that the heat be introduced into an ongoing process (e.g. coal gasification) which is effected at high temperatures (approx. 900° C.), there are great problems with respect to the choice of suitable materials for the construction of the heat exchanger. The material used should be able to provide as long a service life as possible at the high temperatures discussed (the service life of the plant is approximately 30 years). Also, the metal components utilized as discussed above have only very small strength factors at such temperatures, therefore, their demands are limited.

SUMMARY OF THE INVENTION

It is, therefore, an object of the present invention to provide a heat exchanger for use in conjunction with nuclear reactor pressure vessels.

It is a further object of the invention to provide a heat exchanger of the type which is constructed such that the loads and stress on the material caused by pressure and temperature differences, the weight of the exchanger itself, and the degree of thermal expansion are minimized to as great a degree as possible.

Another object of the invention is to provide a heat exchanger apparatus comprising a heat exchanger casing having a plurality of box members suspended within the casing, with each box member having a plurality of tubular members disposed within an arrangement which permits the exchange of heat from a hot gas stream flowing outside the tubular members to a cooler gas stream flowing counter-currently within the tubular members. The heat exchanger apparatus is adapted especially for the use in high temperature nuclear reactors and is disposed within a pod in the reactor pressure vessel communicating directly with the reactor core. Thereby, a method of exchanging heat from a primary cooling circuit of a high temperature reactor to an intermediate gas circuit of a heat process plant is achieved.

The above objects are attained according to the invention by providing a heat exchanger apparatus comprising a heat exchanger casing; a plurality of box members suspended within the casing, each box member having an outer guide sleeve member; a plurality of tubular members disposed within each of the outer guide sleeve members; a means for distributing fluid to each of the tubular members; a means for collecting fluid from each of the tubular members; a plurality of fluid supply lines in communication with the distributing means and each of the box members such that each of the box members are suspended within the heat exchanger casing from a fluid supply line; and a central tube portion within the heat exchanger casing arranged for support of a hot gas conduit suspended within the central tube portion.

In one embodiment of the invention, the heat exchanger apparatus contains, as the means for fluid distribution, a main distributor means communicating with a plurality of supply lines which in turn communicate with a distributor cap attached to each of the box members containing the tubular members.

In another embodiment, the means for collecting fluid comprises a collector cap attached to each box member and a plurality of gas tubes communicating at one end with a collector cap and at the other end with a hot gas conduit.

The entire heat exchanger apparatus finds its primary function in the transferring of heat produced in the cooling gas circuit of a high temperature reactor preferably a nuclear reactor to the gas circulating in an intermediate circuit of a process heat plant. Thus, the heat exchanger apparatus is located within a high temperature reactor pressure vessel for example, in a pod-like cavity within the vessel. Preferably the pod is coated by a liner and sealed by a cover plate. The cover plate is removable and enables easy access to the heat exchanger apparatus located within the pod.

According to the invention, the box members are suspended in the vessel such that each box member is attached to the heat exchanger cover plate by the supply line for the distributor corresponding to that particular box. The supply lines are combined within a main distributor and are fixed in the pod cover plate such that they form multiple loops of tubing, each loop arranged in the area above the heat exchanger cover plate. The heat exchanger casing is supported by a flange on the upper portion of the liner of the pod, and a central tube portion is arranged within the heat exchanger, through which the hot gas conduit for the gas of the intermediate circuit is disposed. The conduit is in turn led through the pod cover plate to the outside of the reactor pressure vessel. In this manner the conduit is attached or suspended only at the cover plate of the pressure vessel.

With the heat exchanger according to the invention, expansion resulting from heat is compensated for without any additional material stress as will be later shown. The attachment of the box members or units, which could have, for example, a circular cross section, takes place only in a low temperature region of the heat exchanger (the temperatures around the heat exchanger cover plate reaching at most about 330° C.). Thus, in this area of high strength, stress on the component parts is possible. Compensation for heat expansion of the supply lines is by means of tube loops provided above the heat exchanger cover plate. Thus no unacceptable stresses are present in the areas of severe thermal expansion.

Each box member is attached in the vertical direction only to the heat exchanger cover plate and can thus expand upwards freely during the heating. While the total weight of the box members hang from the relatively cold portion of the supply lines from the distributor located below the heat exchanger cover plate, the weight load diminishes more and more down to the lower end of the box members. Accordingly, the weight loads are small in the hot portion of the exchanger, especially at the level of the entry of the hot cooling gas into the heat exchanger.

The total weight of the heat exchanger is supported by a flange at the liner of the pod. During the starting up (heating up) of the heat exchanger, the heat exchanger casing expands upwardly from the flange to the heat exchanger cover plate (the heating duration here is short) while the box members freely extend downwardly from the heat exchanger cover plate (the heating duration here is very long). The choice of the flange location by the positioning of the lower ends of the box members can be influenced within certain limits during operation of the heat exchanger according to the invention. Also the relative movement between the heat exchanger casing and the box members can be affected by the positioning of the flange.

The central tube or tube portion, arranged within the heat exchanger, communicates with the hot gas conduit carrying gas of the intermediate circuit. This conduit is attached at a place in the cover plate of the pod and it, therefore, cannot expand downwards freely in the central tube.

The hot gas conduit for the gas of the intermediate circuit preferably comprises an external pressure casing, an internal gas conduit casing and thermal insulation arranged between the two casings to protect the heated gas from heat losses.

In another embodiment of the invention, an annular space is provided between the pressure casing of the hot gas conduit of the intermediate circuit gas and the central tube of the heat exchanger, through which flows a bypass stream of cold compressed cooling gas. The bypass stream, having a temperature of approximately 330° C., is fed from the top. The flange of the pod liner is provided with openings for passage of this bypass stream. By means of the bypass stream, the temperature of the pressure casing of the hot gas conduit can be held relatively low (600° C.). The bypass stream is so small that it is heated up rapidly to the temperature of the cooling gas, existing there by the time it leaves the annular space.

Advantageously, a throttle valve may be installed at the inlet into the annular space for controlling the rate of flow of the bypass stream. The temperature of the bypass stream at the lower end of the annular space depends on the flow rate which in turn determines the heat expansion of the pressure casing of the hot gas conduit. By suitable control of the bypass stream, and a corresponding proper choice of the location of the heat exchanger flange, it is possible to match the heat expansion occuring during the heating of the heat exchanger so that it does not interfere with the relative expansion between the collectors, disposed at the lower end of the box members and the lower end of the hot gas conduit for the intermediate circuit gas.

Only small relative expansion between individual box members can occur, which may be compensated for by means of loops in the gas tubing, connecting the box collectors to the hot gas conduit of the intermediate circuit.

Thus, in the heat exchanger according to the present invention, additional material apparatus stress does not exist because the heat expansion is adequately compensated.

A particularly advantageous construction assures reduced stress in the box member collectors, where the gas of the intermediate circuit, heated in the tubes, is accumulated. This is accomplished by arranging as many boxes as possible with correspondingly small diameters in the heat exchanger. The diameter of the collectors, as well as the distributors, are chosen to be only slightly larger than that of the box members themselves.

Preferably, the collectors of the box members are arranged outside of the flowing field of the cooling gas, i.e., they are arranged in a chamber in which the cooling gas is continually accummulating separate from the primary circuit.

In order to further reduce the stress on the collector, the heat exchanger is advantageously sealed between the tubes of the individual box members which divide the chamber in which the collectors are located, from the remaining part of the heat exchanger, fed by cooling gas. The seal is provided with small openings for the passage of the bypass stream. By means of the seal, the temperatures at the inner and outer side of the collector as well as for the hot gas conduit for the intermediate circuit gas and for the gas carrying tubes between the collectors and the hot gas conduit are nearly the same (approximately 900° C.). As a result, no loads or stresses due to a temperature drop can occur.

As an additional aspect of the invention, a method is disclosed for using the heat exchanger apparatus, such that a first gas is heated by virtue of its contact with the outer surface of a high temperature reactor. The gas then flows into the heat exchanger casing and thereafter into the box members where it is cooled by virtue of its upward flow in the box members. The gas next flows through a blower means where it is compressed and then directed into contact with the outside of the heat exchanger casing. The gas is split into two streams. A major portion of the gas forms a stream that is directed back into contact with the nuclear reactor while the remaining portion forms a bypass stream that is directed into the clearance space located between the heat exchanger casing and the pod lines. Concurrent with the flow of the first gas, a second gas is flowed through the tubes within the box members such that it flows counter-currently to the flow of the first gas stream from the reactor. The second gas stream is then collected within the collectors and thereafter passed through the gas carrying tubes to the central gas conduit. At this stage the second gas has been heated during its flow through the tubular members as heat is transferred from the first gas flowing counter-currently outside the tubular members but within the box members.

The bypass stream mentioned above is directed to flow through the annular space between the outer casing of the hot gas conduit and the central tube portion in a direction counter-current to the flow of gas in the hot gas conduit. Thereafter, it is permitted to accumulate in the area of the collectors until it flows out into the circuit of the first gas.

BRIEF DESCRIPTION OF THE DRAWINGS

The drawings schematically illustrate a heat exchanger according to the invention which may be a helium/helium heat exchanger for a coal gasification plant with steam. The necessary heat energy is produced in a high temperature reactor.

DETAILED DESCRIPTION OF THE INVENTION

Figure 1:
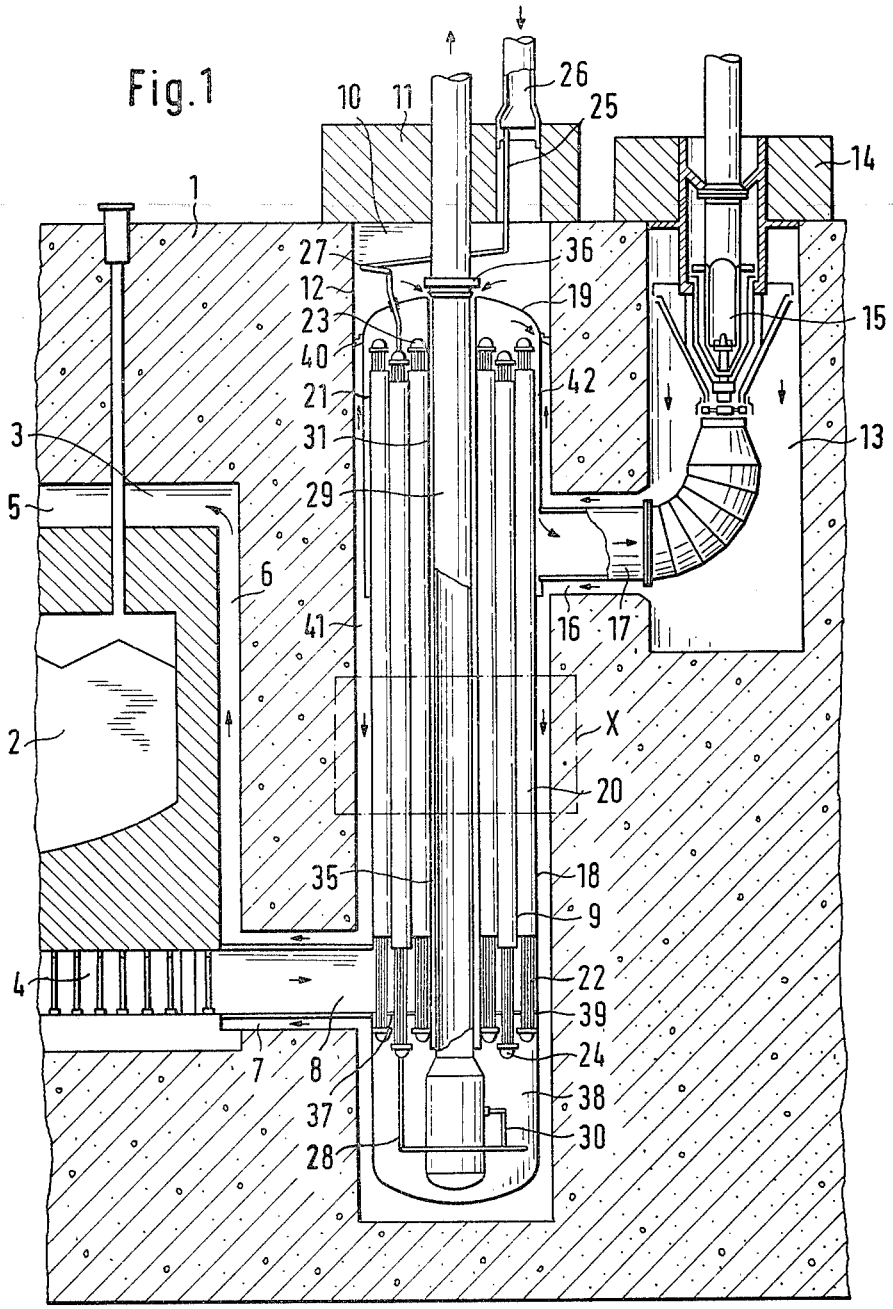
FIG. 1 shows a longitudinal cross-sectional view of the heat exchanger and the other components of the cooling gas circuit.

As may be seen in FIG. 1, a high temperature helium cooled nuclear reactor 2 is installed in a cavity 3 in a prestressed concrete vessel 1. A hot gas accumulation chamber 4 is provided below the core area of reactor 2. Above the core area of the reactor 2, a cold gas accumulation chamber 5 is provided and the accumulation chamber is in communication with an annular chamber 6, arranged around the core area of the reactor. A hot gas conduit 8 is arranged coaxially in a horizontal passageway 7, which also communicates at one end thereof with the annular chamber 6. Gas conduit 8 extends from the hot gas accumulation chamber 4 at one end to the heat exchanger 9 at its other end.

The heat exchanger 9 is arranged in a pod 10, coated by a liner 12 located within the prestressed concrete vessel 1 and is closed by a prestressed concrete cover plate 11. In a further pod 13 which is also provided with a prestressed concrete cover plate 14, there is installed a blower 15. Between pod 10 and pod 13, there is arranged a horizontal passageway 16 in which a gas conduit 17 is coaxially arranged. This conduit connects the heat exchanger 9 to the blower 15.

The heat exchanger 9 has an exchanger casing 18 which is closed by a cover plate 19. Within the casing 18, there are existing a number of circular boxes 20. Each box 20 consists of a tube or guide sleeve 21 open on both sides, a tube assembly or bundle 22, a distributor 23 at the upper end and a collector 24 at the lower end of the tube bundle 22. By means of supply lines 25 which connect the distributors 23 of the boxes 20 to a main distributor 26 installed in the prestressed concrete cover plate 11, the boxes 20 are suspended from the heat exchanger cover plate 19 so that they can freely expand upwardly. In the area below the heat exchanger cover plate 19, the supply lines 25 are located in a looped tube arrangement 27 to provide compensation as needed upon expansion.

The collectors 24, existing below the opening 7 in the heat exchanger 9, are connected in each case by gas tubing 28 through loop 30 to a central gas conduit 29 for the gas of the intermediate circuit. The central hot gas conduit 29 runs through a central tube 31, arranged in the heat exchanger 9 and through the prestressed concrete cover plate 11, in where it is attached. Thus it can freely expand downwardly. The central gas conduit 29 consists of an external pressure casing 32, an internal gas line casing 33 and thermal insulation 34 provided between the two casings.

Figure 2:
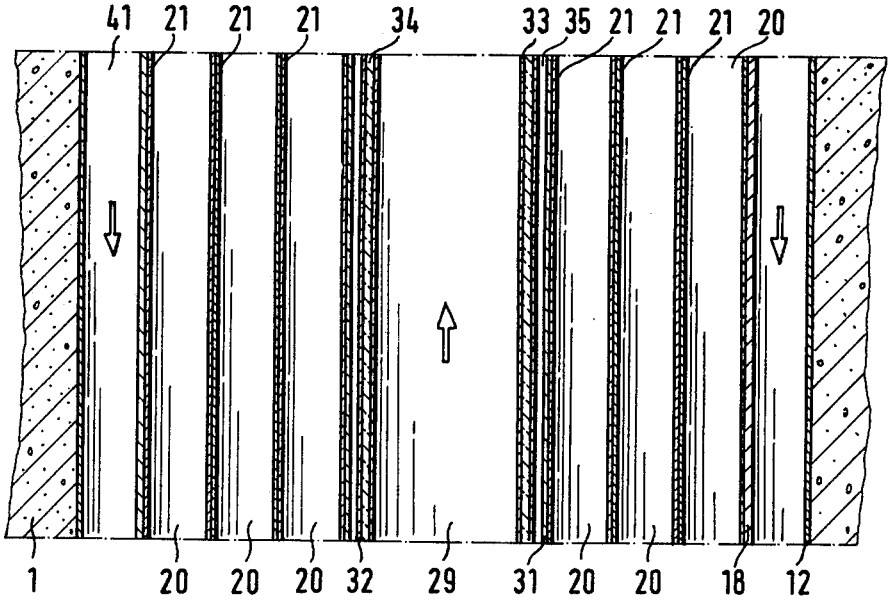
FIG. 2 shows a blown up cross-sectional view of area X shown in FIG. 1.

Between the pressure casing 32, the central hot gas conduit 29 and the central tube 31, there is an annular or clearance space 35 (see also FIG. 2) through which flows a bypass stream of cold compressed cooling gas. By means of a throttle valve 36, which is installed directly at the entry into the annular space 35, the magnitude of the bypass stream may be collected. After leaving the annular space 35, the gas of the bypass stream is again mixed with the hot cooling gas flowing into the heat exchanger 9.

As has already been mentioned, the collectors 24 of the boxes 20 are arranged in the heat exchanger 9 below the discharging point of the opening 7, i.e. they are in chamber 38 which is filled with the accumulating stagnant cooling gas. By means of the seals 37 between the single tubes of the tubular members 22, this chamber is separated from the active part of the heat exchanger 9. The seals 37 have a number of small aperature 39 through which only the relatively small bypass stream is again fed back to the cooling-gas circuit.

At the upper area of the heat exchanger casing 18, there is attached, for example near the top portion of the exchanger 19, a flange 40 by which the weight of the total heat exchanger 9 is transferred to the liner 12 of the pod 10. The flange 40 has openings (not shown) permitting the access of the bypass stream to the annular space 35. Between the heat exchanger casing 18 and the liner 12, there exists an annular chamber or free space 41, which is used for the feed of the cold compressed cooling gas and which is in communication with the horizontal openings 7 and 16. A further annular chamber of free space 42 is provided between the guide sleeve 21 and the boxes 20, arranged on the external circumference and the heat exchanger casing 18. This annular chamber extends up to the area of the open passage 16 between the two pods 10 and 13. It is in communication with the gas conduit 17, leading to the blower 15.

During operation of the heat exchanger and cooling gas circuit, the flow of the cooling gas (helium), as well as the intermediate circuit gas (also helium), flow through the heat exchanger according to the invention as will be clearly shown hereinafter. The cooling gas is designated as primary helium and the intermediate circuit gas as secondary helium.

The primary helium, heated on the average to 950° C. in the high temperature reactor, is accumulated in the hot gas accumulation chamber 4, and is flowed through the hot gas conduit 8 arranged in the opening 7 into the heat exchanger 9 which it enters above the seal 37. The primary helium is passed upwardly along the tubes of the tubular members 22 within the boxes 20 in upward fashion; it heats the secondary helium flowing downwardly in the tubes and is thus cooled down to approximately 330° C. The primary helium is returned to the chamber located above the containers and comes into the gas conduit 17 through the annular chamber 42. From here, the cold primary helium enters the blowers 15 in which it is compressed. Afterward, the primary helium passes back through the pod 13 to the passageway 16 and enters the annular chamber 41 and goes through the horizontal opening 7 into the annular chamber 6. From here, it enters the cold gas accumulation chamber 5 to start the circuit once again.

A very low percentage of the cold gas passes through the openings in the flange 40 for entry into the annular space 35. This bypass stream has a temperature of approximately 330° C. This assumes that the pressure casing 32 is maintained at a low temperature (<600° C.). From the annular space 35, the gas of the bypass stream enters the chamber 38 and passes through the small apertures 39 in the seal 37. Afterward, the bypass stream is mixed with the hot primary helium, coming from the hot gas line 8 and which is flowing upwardly in boxes 20.

The cold secondary helium having a temperature of approximately 200° C. is distributed across the main distributor 26, and the supply lines 25 on the distributors 23 of the boxes 20 and is passed downwardly through the tubular members 22. Because of this passage, it is heated to approximately 900° C. In the collectors 24, the secondary helium is first collected in each container and then led to the central hot gas conduit 29 by means of the gas carrying tubes 28. The hot gas passes upwardly within conduit 29 and is led out of the prestressed concrete vessel 1 though the prestressed concrete cover plate 11 for further use.

Although the exchanger of the invention was described as being used in conjunction with helium, it should be understood the exchanger may be used with any suitable fluids.

The above description describes a preferred embodiment of the invention using certain preferred gases and temperatures. It is to be understood, however, that the invention is not limited to any single embodiment or any particular gases or temperatures, but should be construed to cover all modifications and alternative embodiments falling within the scope of the invention as defined by the claims which follow.

What is claimed is:

1. A heat exchanger apparatus comprising:
- a heat exchanger casing mounted within a pod of a high temperature reactor pressure vessel;
- a cover plate arranged for sealing said pod of the high temperature reactor pressure vessel;
- a plurality of box members suspended within said casing, each box member having an outer guide sleeve member;
- a plurality of tubular members disposed within each of said outer guide sleeve members;
- a main distributor member mounted in said cover plate;
- means for collecting fluid from each of said tubular members;
- a plurality of fluid supply lines in communication with said main distributor member, each fluid supply line also communicating with a box member such that each of said box members are suspended within said heat exchanger casing from a fluid supply line;
- a plurality of distributor caps, each cap attached to a box member and tubular members and one of said supply lines;
- a central tube portion within said heat exchanger casing, housing a hot gas conduit in communication with a gas circuit of a process heat plant an inner gas conduit casing surrounding said hot gas conduit and an outer pressure casing surrounding said inner gas conduit casing; and
- a reactor cooling supply conduit arranged for supplying hot cooling gas from a reactor core cooling circuit to the inside of said heat exchanger casing.

2. The heat exchanger apparatus of claim 1 wherein said pod is coated by a liner.

3. The heat exchanger apparatus as defined by claim 1, wherein said means for collecting fluid comprises a collector cap attached to said box member and tubular members and a plurality of gas-carrying tubes communicating at one end with a collector cap and at the other end with said hot gas conduit.

4. The heat exchanger apparatus as defined by claim 1, wherein a flange at the upper portion of said liner provides the primary support means for said heat exchanger casing within said pod.

5. The heat exchanger apparatus as defined by claim 1, wherein each of said supply lines are arranged in loops or spirals above one of said box members, said supply line loops or spirals being of sufficient length and flexibility to compensate for the thermal expansion of the box members within said heat exchanger casing.

6. The heat exchanger apparatus as defined by claim 1, wherein said hot gas conduit is attached and suspended from said pod cover plate.

7. The heat exchanger apparatus as defined by claim 1, wherein said inner gas conduit casing surrounds, in intimate contact, said hot gas conduit, and wherein said outer pressure casing surrounding said hot gas conduit defines an area around said hot gas conduit for thermal insulation.

8. The heat exchanger apparatus as defined by claim 3, wherein each of said gas-carrying tubes are arranged in loops or spirals below one of said box members, said gas-carrying tube loops or spirals being of sufficient length and flexibility to compensate for the thermal expansion of the box members within said heat exchanger casing.

9. The heat exchanger apparatus as defined by claim 3, wherein the diameter of each of said distributor caps and each of said collector caps are of substantially the same diameter as the communicating outer guide sleeve member.

10. The heat exchanger apparatus as defined by claim 7 comprising further an annular space between said outer pressure casing and said central tube portion for the passage of a bypass stream of cold compressed cooling gas and wherein passageways are provided in the flange supporting the heat exchange casing for the passage of said bypass stream.

11. The heat exchanger apparatus as defined by claim 10 further comprising a throttle valve for the control of said bypass stream.

12. The heat exchanger apparatus as defined by claim 11, wherein each of said collector caps are positioned outside the direct flow of cooling gas in said cooling gas circuit.

13. The heat exchanger apparatus as defined by claim 12, wherein the area containing said collector caps is separated from the area of direct flow of said cooling gas by a seal communicating with said heat exchanger casing and each of said outer guide sleeve members and having openings for the passage of a bypass stream of cooling gas.

14. The heat exchanger apparatus as defined by claim 13 further comprising a blower-compressor arranged in a separate pod within said high temperature reactor pressure vessel and sealed by a cover plate, said blower compressor being in communication with the flow of said cooling gas and said pod being in communication with said pod containing said heat exchanger casing.

15. A method for the transmission of heat produced in the reactor core cooling circuit of a high temperature reactor to a circulating gas in a process heat plant comprising:

heating a first gas by flowing contact with a high temperature reactor;

flowing said heated gas into a heat exchanger casing through a plurality of box members each comprised of a plurality of tubular members to substantially cool said gas;

flowing said substantially cooled gas into a blower compressor unit to compress said substantially cooled gas;

flowing the major portion of said compressed cooled gas to a cooling gas accumulation chamber arranged above the core of a high temperature reactor;

flowing the remaining portion of said compressed cooled gas in a bypass stream to an accumulating area and substantially into the area of circulation of said first gas;

flowing a second gas through a main distributor member mounted in a cover plate of a pressure reactor vessel housing said high temperature reactor into a plurality of supply lines communicating with said plurality of tubular members;

flowing said second gas through said tubular members in a direction opposite to the flow of said heated first gas in said box members to effect substantial cooling of said heated first gas;

flowing said second gas from said tubular members to a conduit arranged in a central tube portion of said heat exchanger casing; and flowing said second gas out of said heat exchanger casing to a process heat plant.

16. The method of claim 15 further comprising the flowing of said bypass stream into an annular space between said outer pressure casing and said central tube portion;

flowing said bypass stream through said annular space in a direction counter-current to the flow of gas within the hot gas conduit;

accumulating said bypass stream after flowing through said annular space in an accumulation area; and permitting said accumulated bypass stream to flow through passageways into the area of circulation of said first gas.

* * * * *